US006634330B2

(12) United States Patent
Matsuda et al.

(10) Patent No.: US 6,634,330 B2
(45) Date of Patent: Oct. 21, 2003

(54) VALVE SYSTEM FOR ENGINE

(75) Inventors: Minoru Matsuda, Saitama (JP); Makoto Sanada, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/988,003

(22) Filed: Nov. 16, 2001

(65) Prior Publication Data

US 2002/0056429 A1 May 16, 2002

Related U.S. Application Data

(60) Provisional application No. 60/248,551, filed on Nov. 16, 2000.

(30) Foreign Application Priority Data

Nov. 16, 2000 (JP) ..... 2000-349952
Oct. 30, 2001 (JP) ..... 2001-333341

(51) Int. Cl.[7] ..... F01L 1/18

(52) U.S. Cl. ..... 123/90.39; 123/90.4; 123/90.41; 74/559; 29/888.2

(58) Field of Search ..... 123/90.39, 90.4, 123/90.41, 90.42, 90.34; 74/559, 595; 29/888.2

(56) References Cited

U.S. PATENT DOCUMENTS

| | | | | | |
|---|---|---|---|---|---|
| 1,524,150 | A | | 1/1925 | Rhoads | 123/90.38 |
| 1,725,672 | A | | 8/1929 | Peglar | 123/90.64 |
| 2,311,146 | A | | 2/1943 | Wiegman | 123/55.4 |
| 2,506,250 | A | | 5/1950 | Taub | 123/55.4 |
| 2,610,617 | A | | 9/1952 | Pielstick | 123/90.4 |
| 3,531,234 | A | * | 9/1970 | Ravenel | 123/90.34 |
| 3,730,150 | A | * | 5/1973 | Codner, Jr. et al. | 123/90.18 |
| 3,963,008 | A | | 6/1976 | Bouquet | 123/90.61 |
| 3,967,601 | A | | 7/1976 | Heberle | 123/90.4 |
| 4,327,678 | A | | 5/1982 | Pollet | 123/90.4 |
| 5,492,085 | A | * | 2/1996 | Tiller et al. | 123/90.61 |
| 5,950,590 | A | * | 9/1999 | Everts et al. | 123/196 R |
| 5,964,197 | A | * | 10/1999 | Koishikawa et al. | 123/195 HC |
| 5,983,849 | A | * | 11/1999 | Wangen et al. | 123/90.61 |
| 6,176,211 | B1 | * | 1/2001 | Tanaka et al. | 123/90.61 |
| 6,453,861 | B1 | * | 9/2002 | Nomura et al. | 123/90.23 |
| 6,491,011 | B2 | * | 12/2002 | Sanada et al. | 123/90.39 |

FOREIGN PATENT DOCUMENTS

JP 2000110516 A 4/2000

OTHER PUBLICATIONS

Fukuzawa et al., Four–Cycle Engine, US Patent Application Publication, US 2002/0092494 A1, Jul. 18, 2002.*

* cited by examiner

*Primary Examiner*—Thomas Denion
*Assistant Examiner*—Ching Chang
(74) *Attorney, Agent, or Firm*—Birch, Stewart, Kolasch & Birch, LLP

(57) ABSTRACT

To provide a valve system for an engine, in which a rocker arm is interlocked with an engine valve and is supported on a rocker shaft fixedly mounted to a cylinder head such that it is rockable with the rotation of a camshaft. Accordingly, the size and weight of the engine can be reduced. The posture of a rocker shaft is set to have an axial line crossing an axial line of a crankshaft on the projection plane perpendicular to an axial line of a cylinder bore. A rocker arm is rockably supported by the rocker shaft and is provided with an input arm extending, on the above projection plane, from the rocker arm to the camshaft side. A pull rod reciprocates in the axial direction with the rotation of the camshaft and is connected to the input arm.

15 Claims, 14 Drawing Sheets

VALVE SYSTEM FOR ENGINE

CROSS-REFERENCES TO RELATED APPLICATIONS

This nonprovisional application claims priority under 35 U.S.C. §119(a) on Patent Application No. 2000-349952 filed in Japan on Nov. 16, 2000, and Patent Application No. 2001-333341 filed in Japan on Oct. 30, 2001, the entirety of each of which is herein incorporated by reference. This nonprovisional application further claims priority under 35 U.S.C. §119(e) on U.S. Provisional Application No. 60/248,551, filed on Nov. 16, 2000, the entirety of which is herein incorporated by reference.

BACKGROUND OF THE INVENTION

1. Field of the Invention

The present invention relates to a valve system for an engine. In particular, the present invention relates to an improved valve system for an engine, wherein a rocker arm is interlocked with an engine valve and is supported by a rocker shaft fixedly supported by a cylinder head such that it is rockable with the rotation of a camshaft of the engine.

2. Description of Background Art

A valve system of this type has been known, for example, from Japanese Patent Laid-open No. Hei 2000-110516.

The above-described background art valve system is of an overhead cam type, wherein a camshaft is disposed over a cylinder head. In this valve system, to transmit rotational power of the crankshaft to the camshaft at a reduction ratio of 1/2, it is required to ensure a space on one end of the crankshaft for disposing power transmission means, such as a cam chain. This results in the width of the engine increasing in the direction along the axial line of the crankshaft. Accordingly, the weight of the engine is increased.

SUMMARY OF THE INVENTION

In view of the foregoing, the present invention has been made, and an object of the present invention is to provide a valve system of an engine, which is capable of reducing the size and weight of the engine.

To achieve the above object, according to a first aspect of the present invention, a valve system for an engine includes a crankshaft rotatably supported by a crankcase such that it is connected to a piston slidably fitted in a cylinder bore. A camshaft has an axial line parallel to an axial line of the crankshaft and is interlocked with the crankshaft at a reduction ratio of 1/2. A rocker arm is interlocked with engine valves and is supported by a rocker shaft fixedly supported by a cylinder head such that it is rockable with the rotation of the camshaft. The camshaft disposed on one side of the crankshaft is rotatably supported by the crankcase. The posture of the rocker shaft is set to have an axial line crossing the axial line of the crankshaft on the projection plane perpendicular to an axial line of the cylinder bore. An input arm extending on the projection plane from the rocker arm to the camshaft side is provided on the side of the rocker arm which is rockably supported by the rocker shaft. A pull rod reciprocating in the axial direction with the rotation of the camshaft is connected to the input arm in order to rock the rocker arm in the valve opening direction when the pull rod is moved to the camshaft side.

With this configuration, since the posture of the rocker shaft is set to have an axial line crossing the axial line of the crankshaft on the projection plane perpendicular to an axial line of the cylinder bore, a space required for disposing the rocker shaft, the rocker arm, and the like constituting part of the valve system can be made smaller in the direction along the axial line of the crankshaft. Also, since the input arm extends from the rocker arm to the camshaft disposed on one side of the crankshaft, and the pull rod reciprocating in the axial direction with the rotation of the camshaft is connected to the input arm, it is not required to enlarge the width of the cylinder head in the direction along the axial line of the crankshaft for disposing the pull rod. This results in the possibility of reducing the size and weight of the engine in the direction along the axial line of the crankshaft.

To achieve the above object, according to the second aspect of the present invention, a valve system for an engine includes a crankshaft which is rotatably supported by a crankcase such that it is connected to a piston slidably fitted in a cylinder bore. A camshaft has an axial line parallel to an axial line of the crankshaft and is interlocked with the crankshaft at a reduction ratio of 1/2. A first rocker arm is interlocked with first engine valves and a second rocker arm is interlocked with second engine valves different in kind from the first engine valves. The first and second rocker arms are respectively supported by a first rocker shaft and a second rocker shaft, which are fixedly supported by a cylinder head, such that they are rockable with the rotation of the camshaft. The camshaft is disposed on one side of the crankshaft and is rotatably supported by the crankcase. The first rocker arm corresponding to a pair of the first engine valves and the second rocker arm corresponding to a pair of the second engine valves are disposed in the cylinder head such that they face the combustion chamber. The first and second rocker arms are rockably supported by the first rocker shaft and the second rocker shaft, respectively. The first and second rocker shafts have axial lines crossing the axial line of the crankshaft on the projection plane perpendicular to an axial line of the cylinder bore and are disposed in parallel to each other. A first input arm and a second input arm extend on the projection plane from the first rocker arm and the second rocker arm to the camshaft side and are provided on the first rocker arm and the second rocker arm, respectively. A push rod reciprocating in the axial direction with the rotation of the camshaft is connected to the first input arm in order to rock the first rocker arm in the valve opening direction when the push rod is moved on the side opposite to the camshaft. A pull rod reciprocating in the axial direction according to the rotation of the camshaft is connected to the second input arm in order to rock the second rocker arm in the valve opening direction when the pull rod is moved on the camshaft side.

With this configuration, since the pair of first engine valves and the pair of second engine valves are disposed in the cylinder head such that they face the combustion chamber, it is possible to improve the suction efficiency and increase the output torque in a low speed rotational range. Since the postures of the first and second rocker shafts are set to have axial lines thereof crossing the axial line of the crankshaft on the projection plane perpendicular to the axial line of the cylinder bore, a space required in the cylinder head for disposing the first and second rocker shafts, the first and second rocker arms, and the like constituting part of the valve system can be made smaller in the direction along the axial line of the crankshaft. Furthermore, since the input arms extend from the first and second rocker arms to the camshaft disposed on one side of the crankshaft and the pull rod and the push rod reciprocating in the axial direction according to the rotation of the camshaft are connected to the input arms of both the rocker arms, it is not required to enlarge the width of the cylinder head in the direction along the axial line of the crankshaft for disposing the pull rod and the push rod. Accordingly, a drive system between the camshaft and the rocker arms can be disposed in good balance. This results in the possibility of reducing the size and weight of the engine in the direction along the axial line of the crankshaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, embodiments of the present invention will be described with reference to the accompanying drawings.

Figure 1:
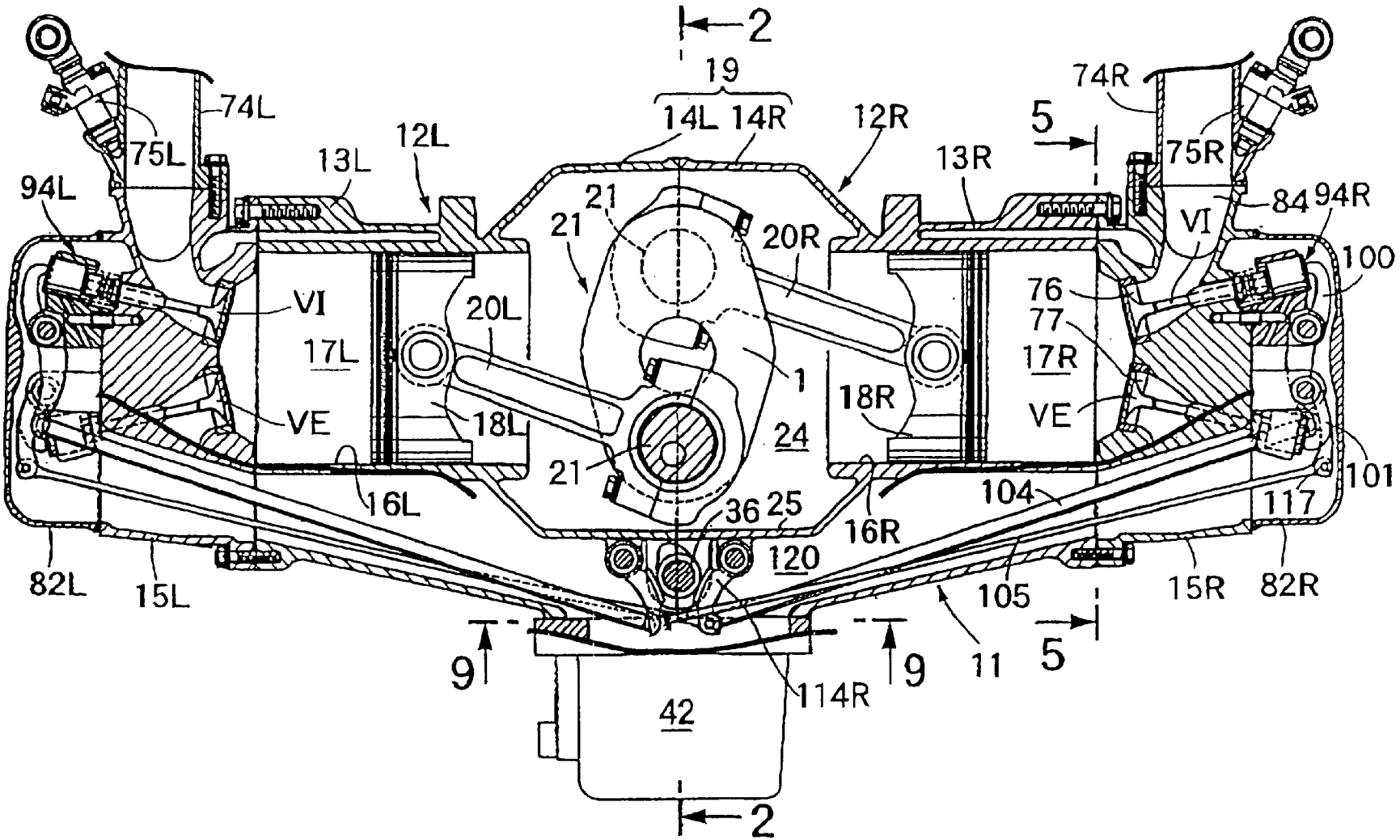
FIG. 1 is a vertical sectional rear view of an engine.
Figure 2:
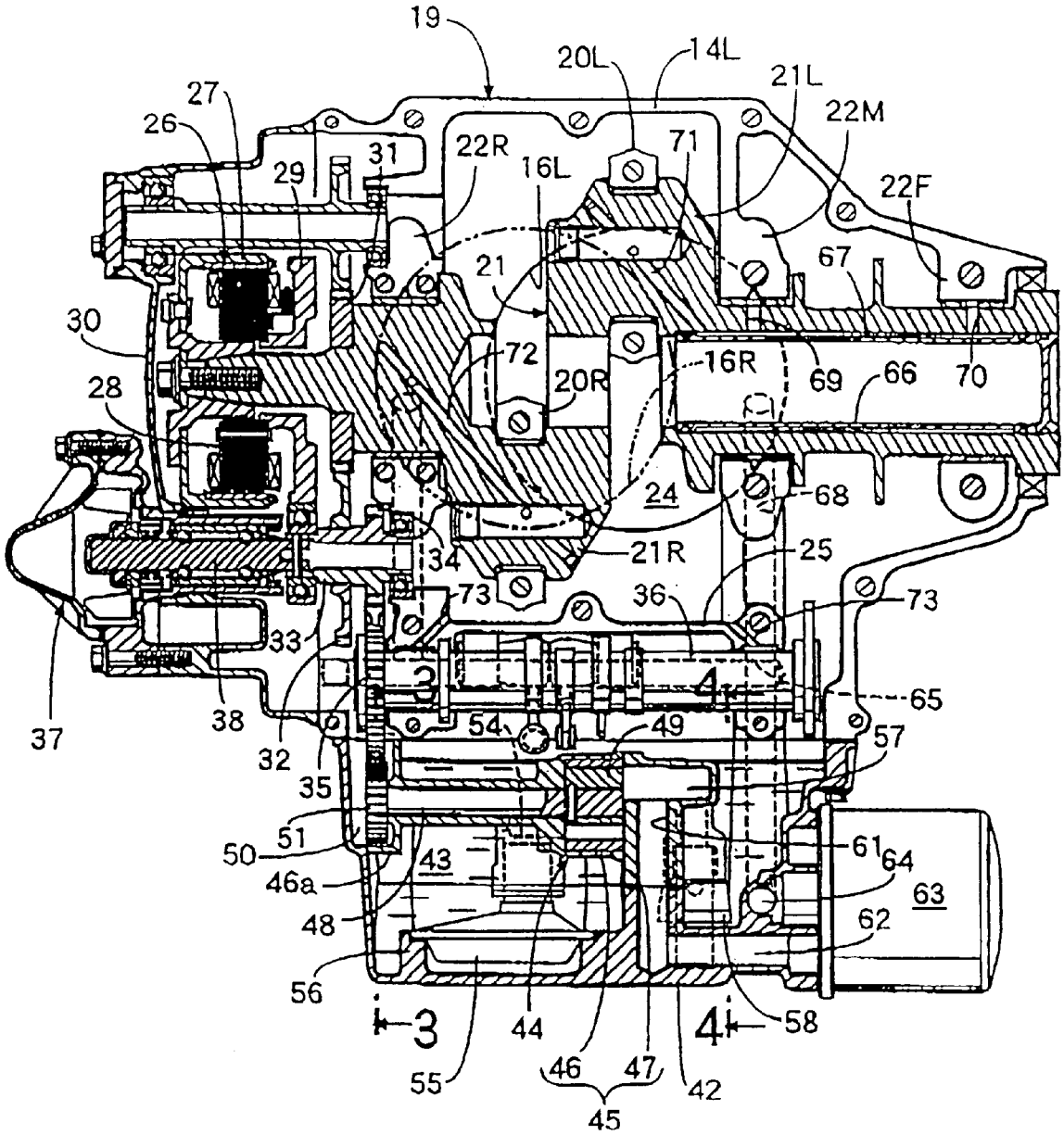
FIG. 2 is an enlarged sectional view along line 2—2 of FIG. 1.
Figure 3:
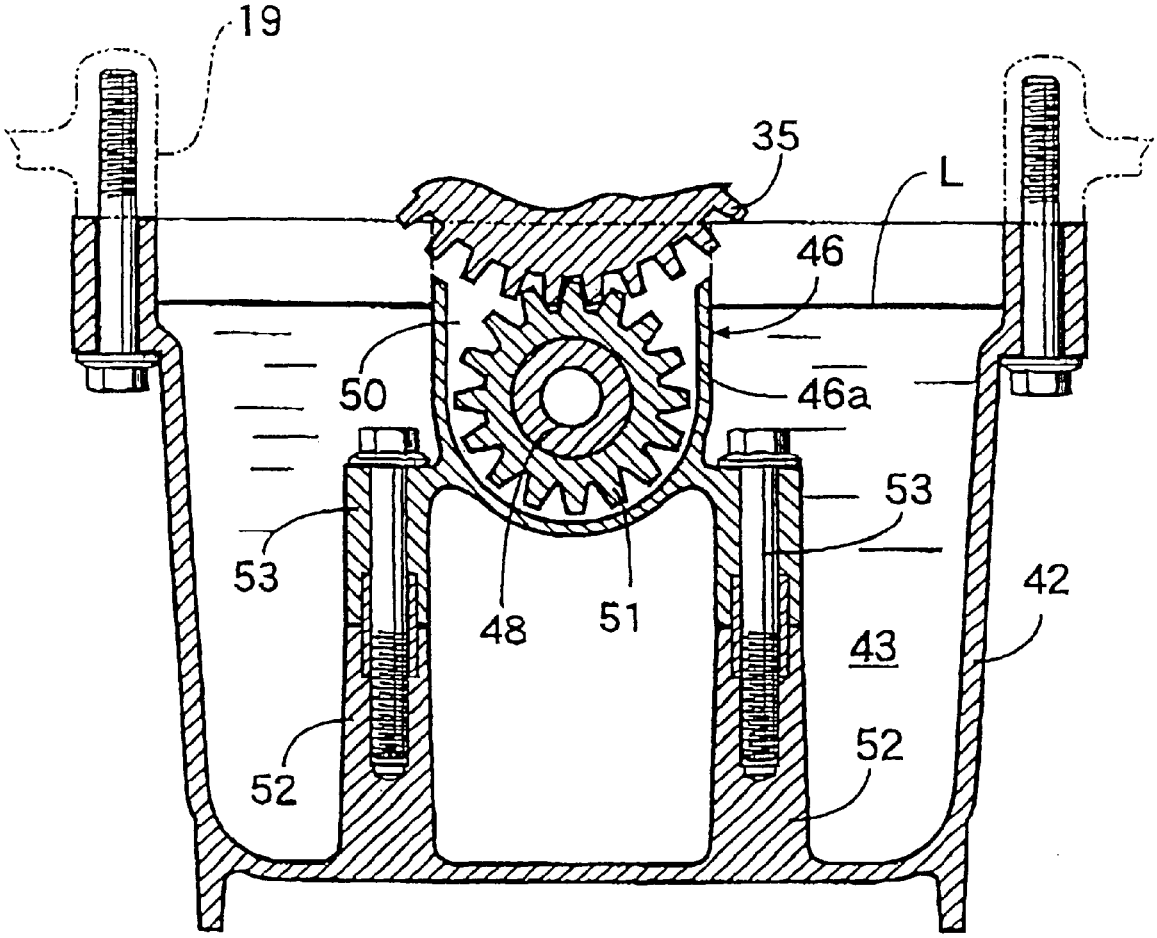
FIG. 3 is an enlarged sectional view along line 3—3 of FIG. 2.
Figure 4:
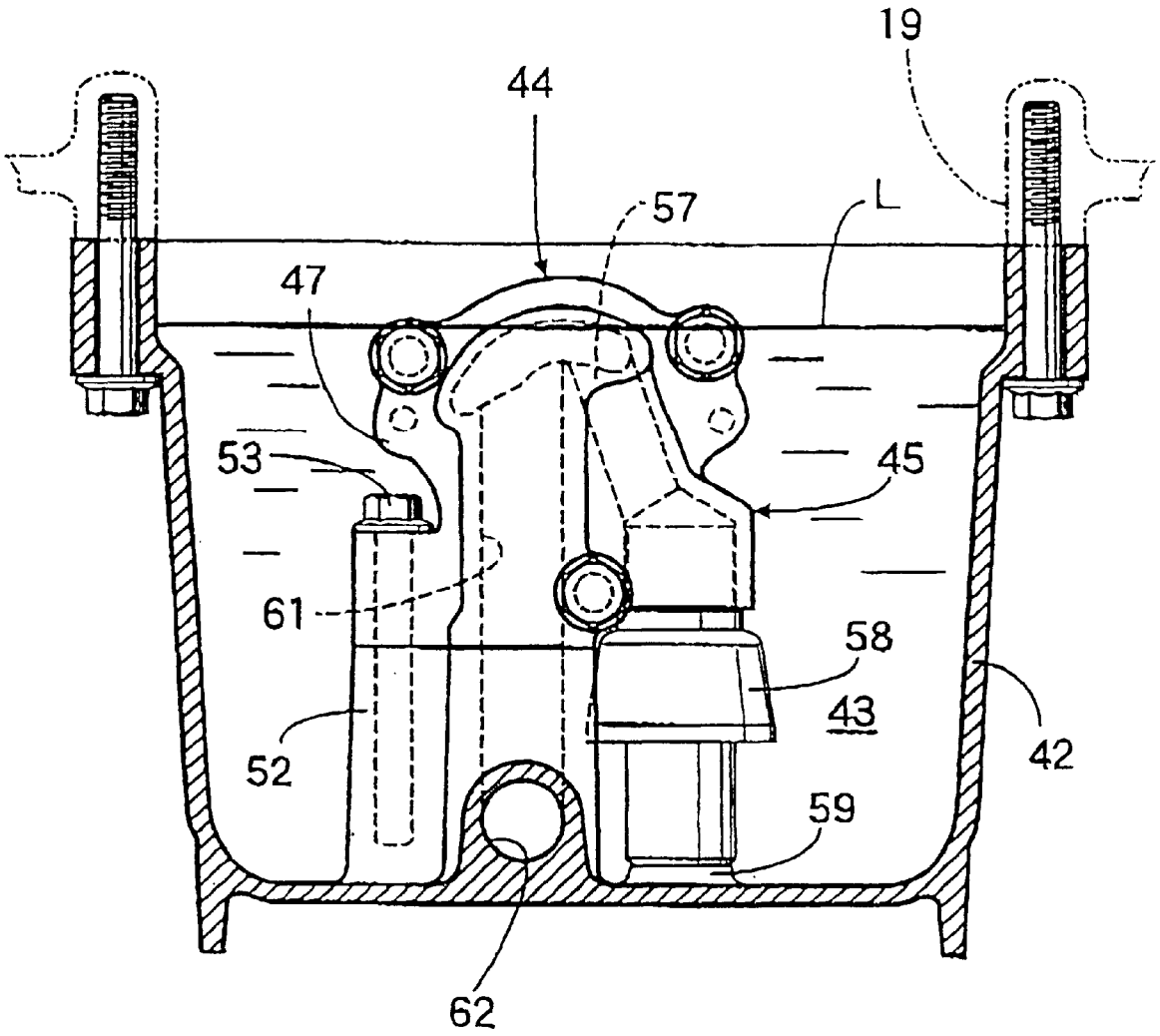
FIG. 4 is an enlarged sectional view along line 4—4 of FIG. 2.
Figure 5:
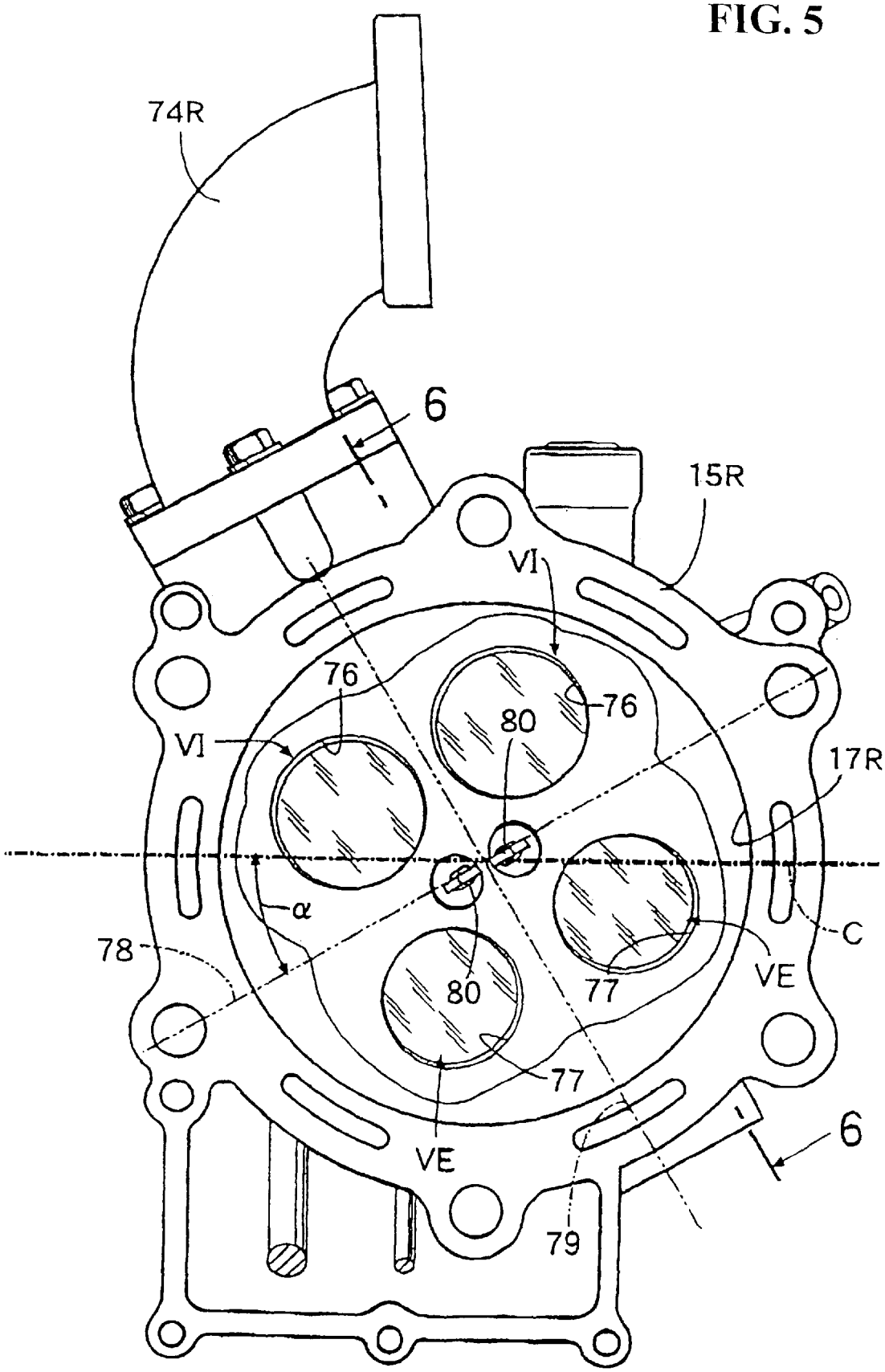
FIG. 5 is a sectional view along line 5—5 of FIG. 1 showing a cylinder head.
Figure 6:
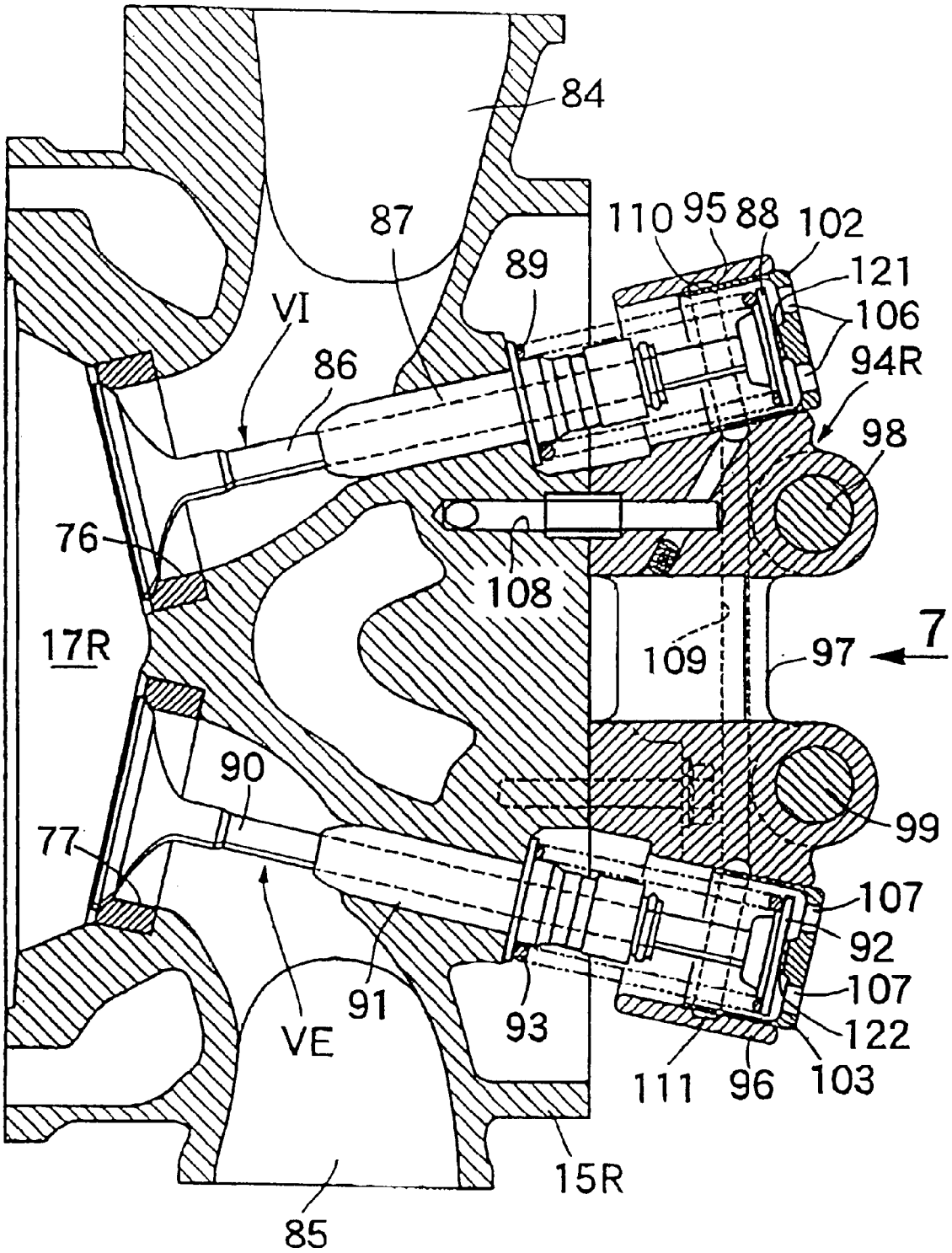
FIG. 6 is a sectional view along line 6—6 of FIG. 5 showing the cylinder head in a state in which a head cover is removed.
Figure 7:
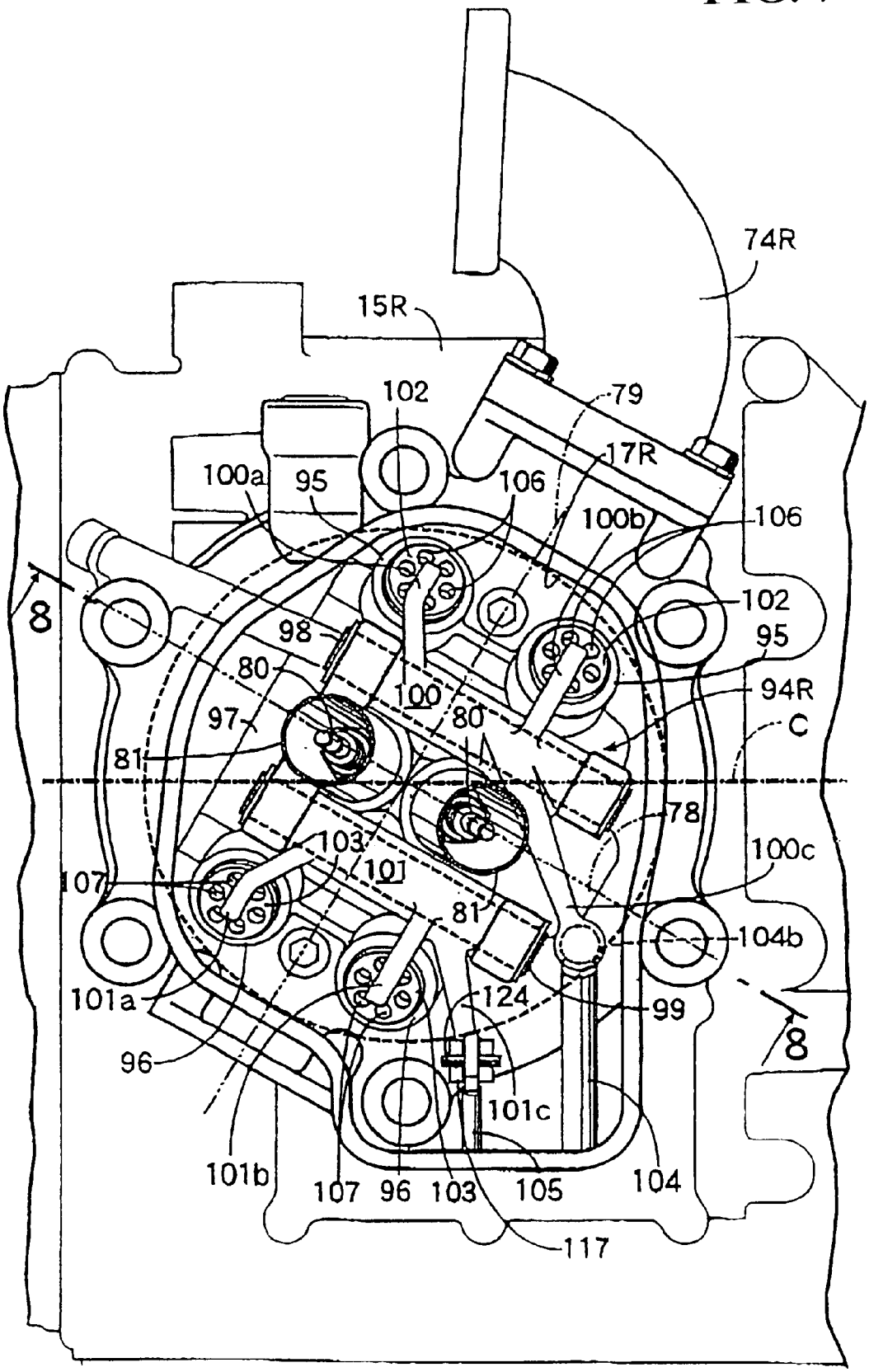
FIG. 7 is a view along an arrow 7 of FIG. 6.
Figure 8:
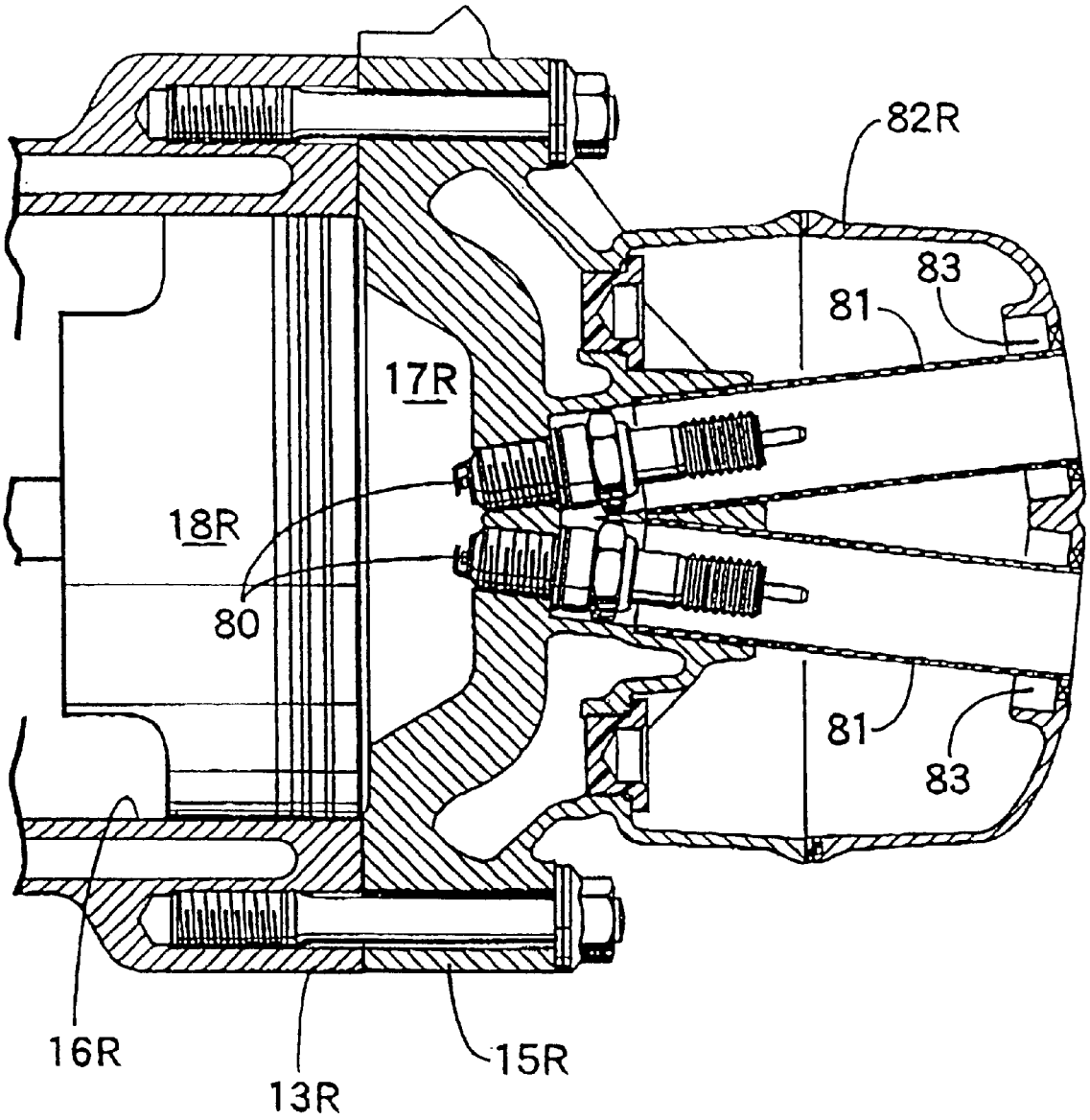
FIG. 8 is a sectional view along line 8—8 of FIG. 7.
Figure 9:
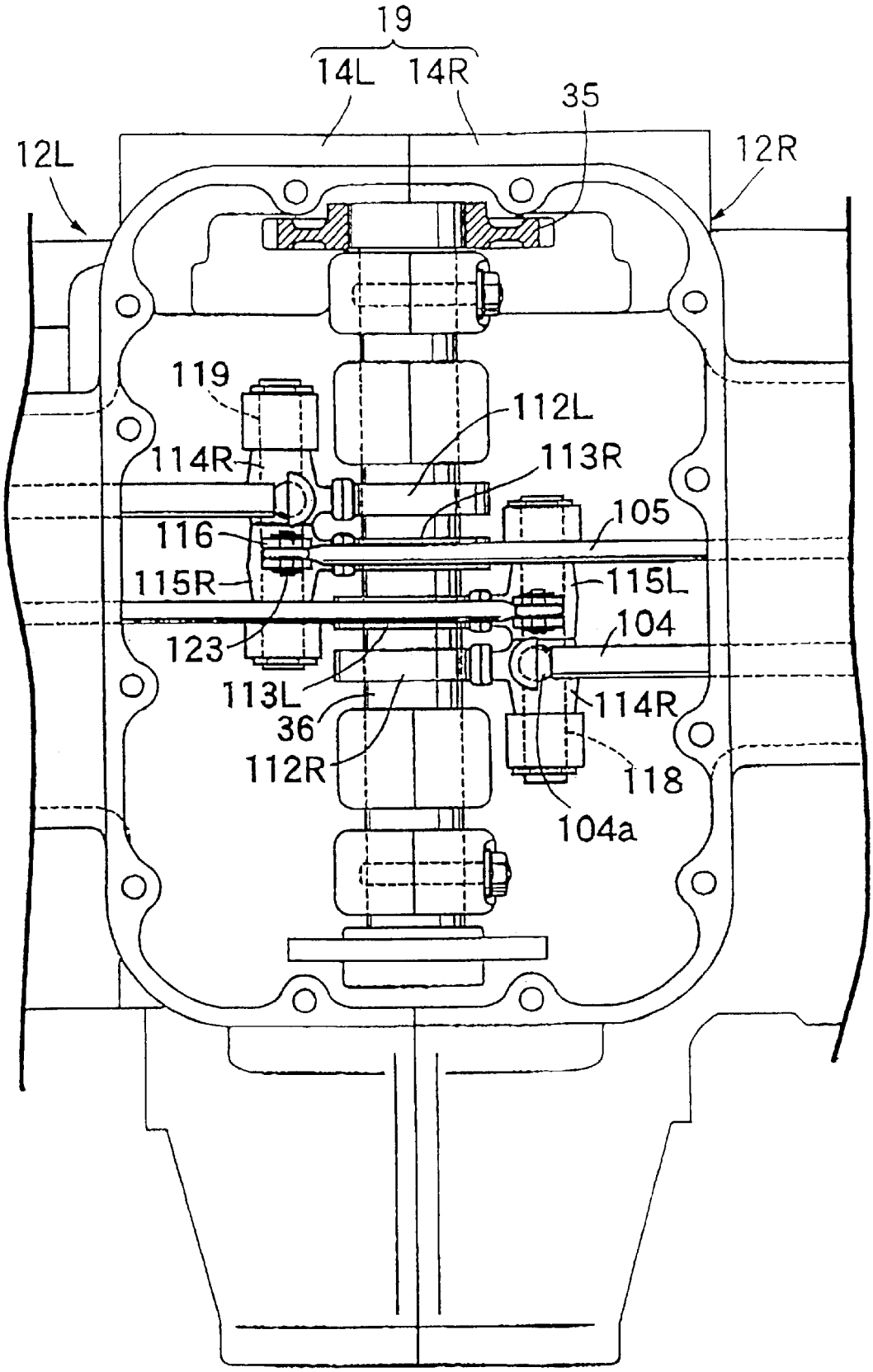
FIG. 9 is a sectional view along line 9—9 of FIG. 1.
Figure 10:
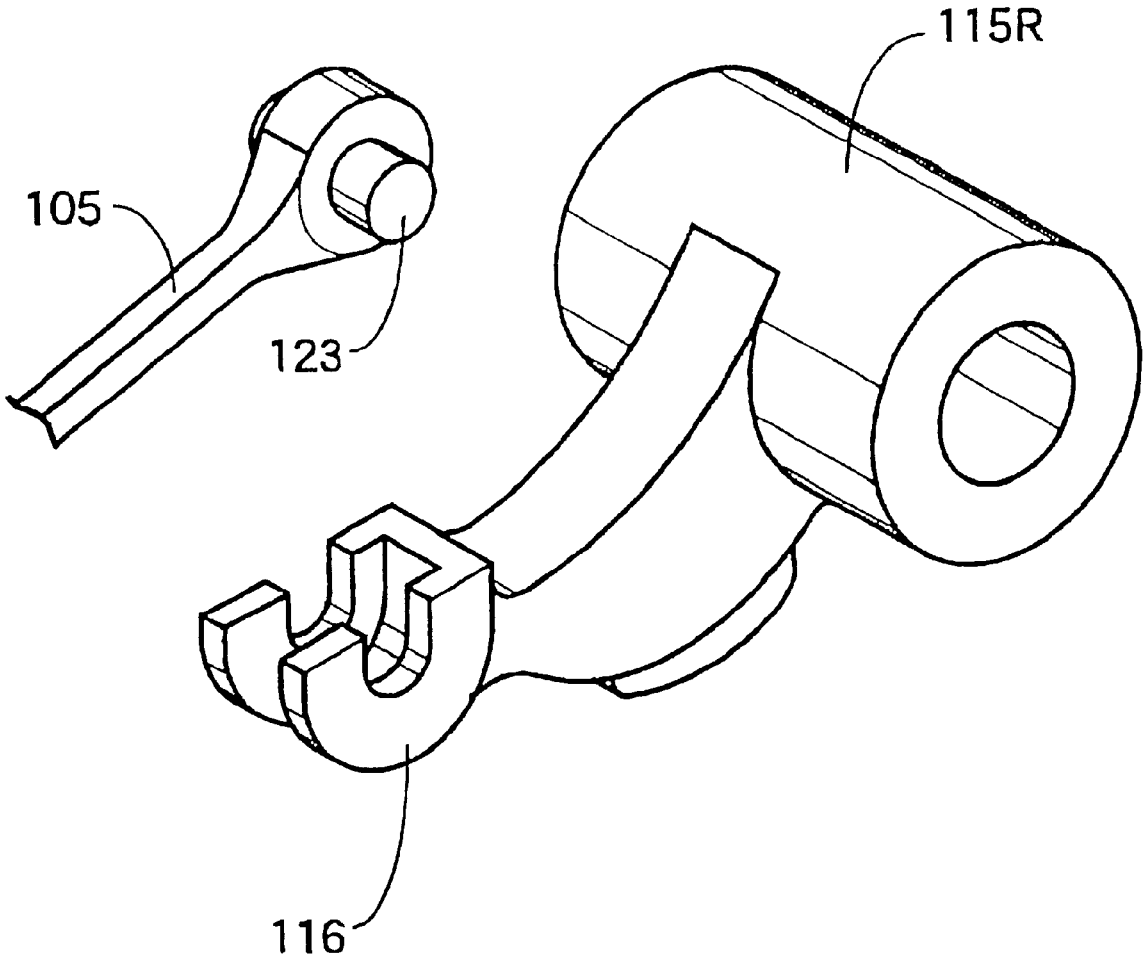
FIG. 10 is an exploded perspective view of a structure for connecting a pull rod to a cam follower.
Figure 11:
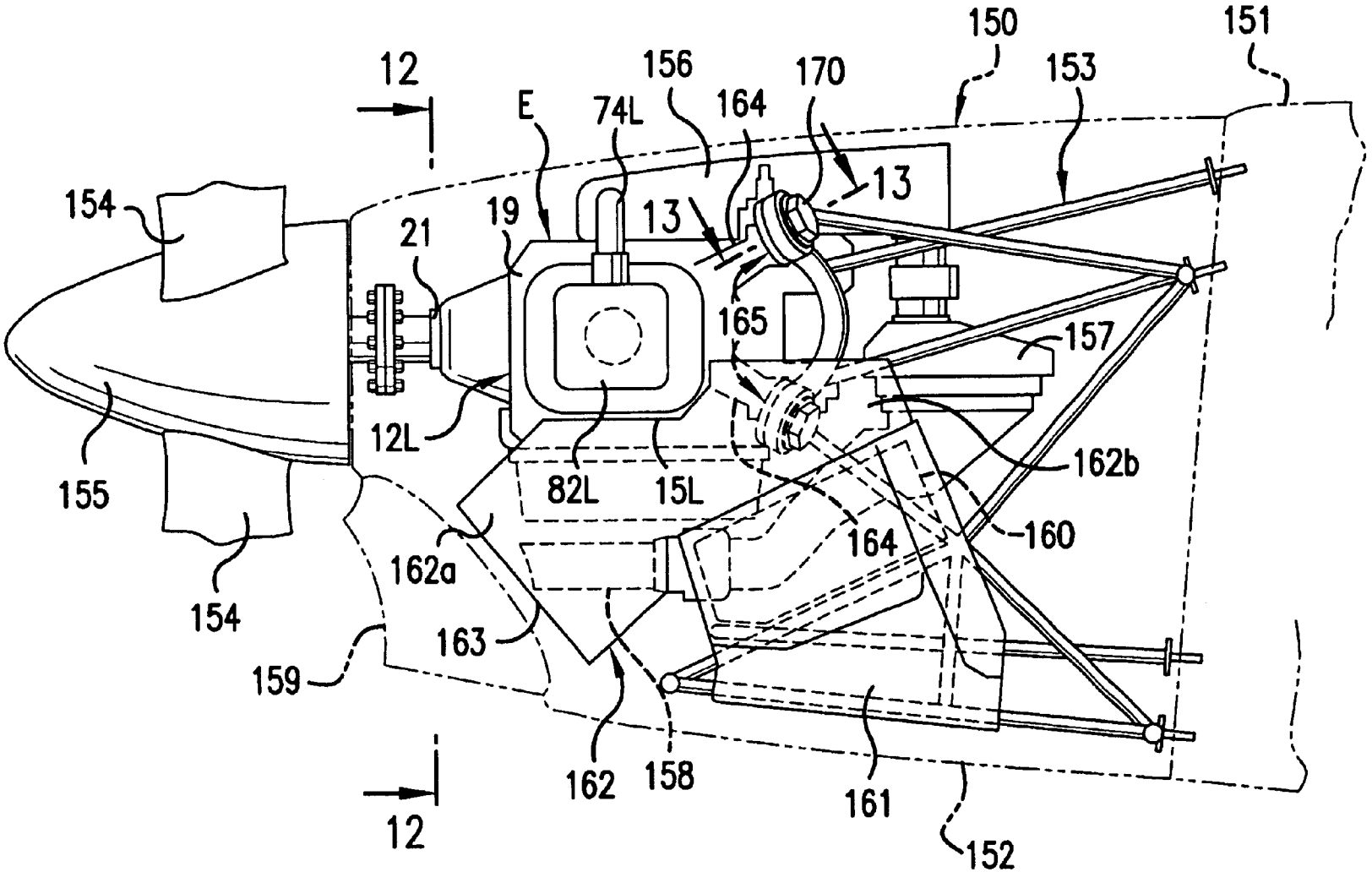
FIG. 11 is a side elevational view showing an engine installed in an airplane.
Figure 12:
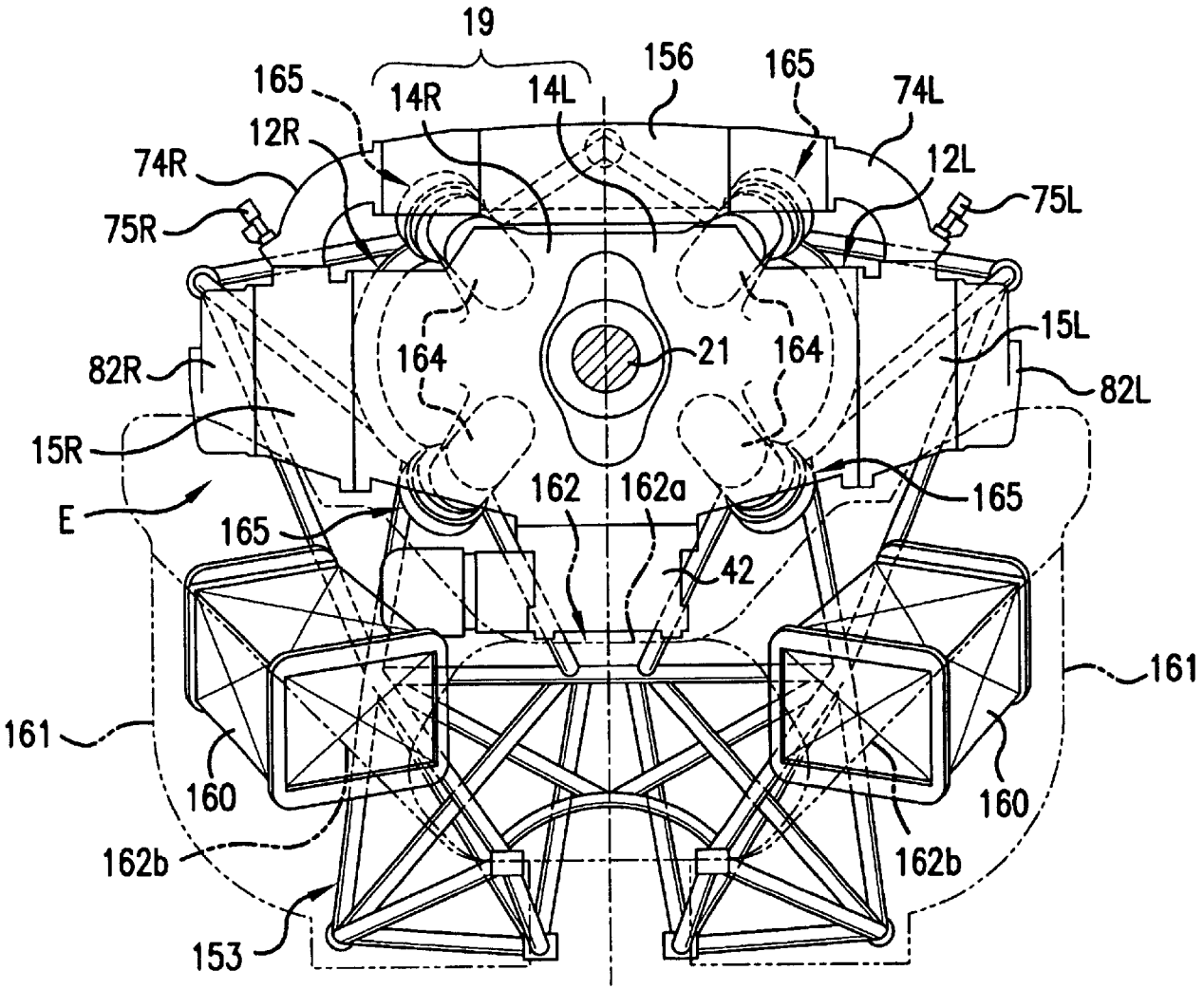
FIG. 12 is a sectional view along line 12—12 of FIG. 11.
Figure 13:
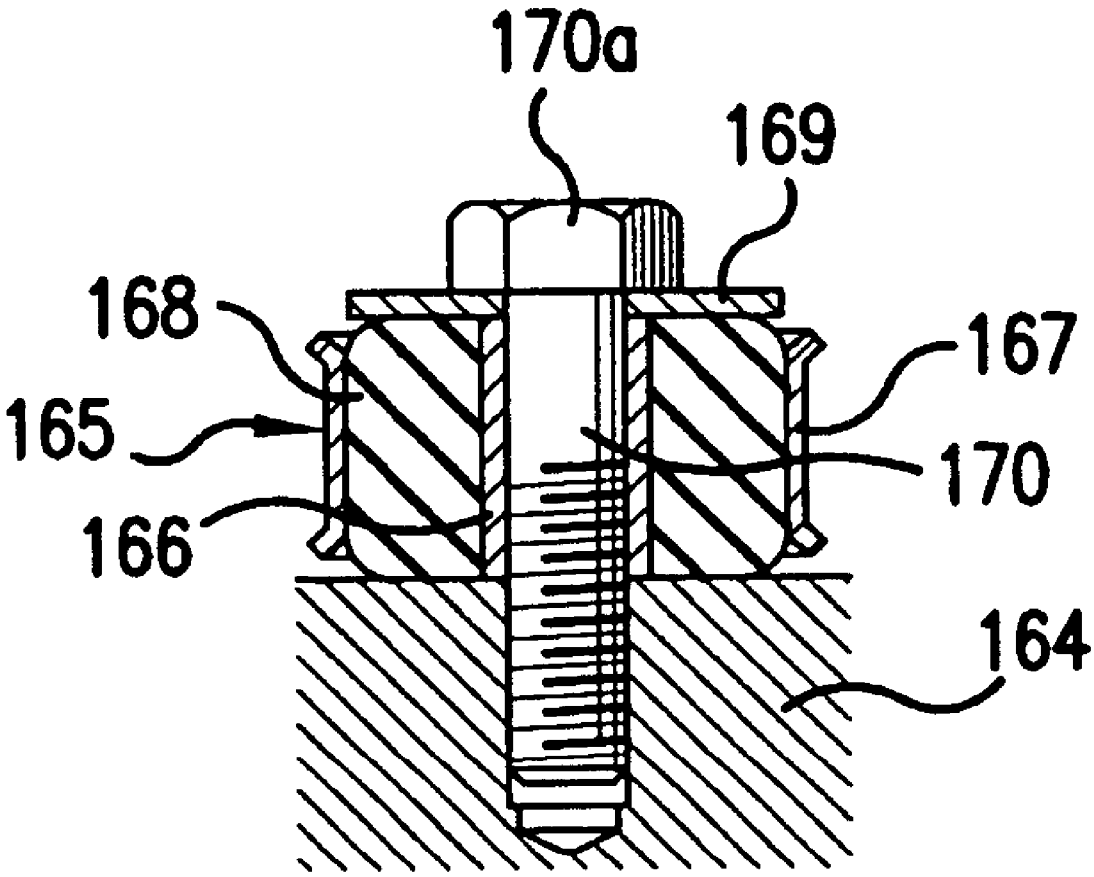
FIG. 13 is an enlarged sectional view along line 13—13 of FIG. 11.

FIGS. 1 to 10 show one embodiment in which the present invention is applied to a four-cycle horizontally opposed type two-cylinder engine, wherein FIG. 1 is a vertical sectional rear view of the engine; FIG. 2 is an enlarged sectional view along line 2—2 of FIG. 1; FIG. 3 is an enlarged sectional view along line 3—3 of FIG. 2; FIG. 4 is an enlarged sectional view along line 4—4 of FIG. 2; FIG. 5 is a sectional view along line 5—5 of FIG. 1 showing a cylinder head; FIG. 6 is a sectional view along line 6—6 of FIG. 5 showing the cylinder head in a state in which a head cover is removed; FIG. 7 is a view along an arrow 7 of FIG. 6; FIG. 8 is a sectional view along line 8—8 of FIG. 7; FIG. 9 is a sectional view along line 9—9 of FIG. 1; FIG. 10 is an exploded perspective view of a structure for connecting a pull rod to a cam follower; FIG. 11 is a side elevational view showing an engine installed in an airplane; FIG. 12 is a sectional view along line 12—12 of FIG. 11; and FIG. 13 is an enlarged sectional view along line 13—13 of FIG. 11.

Referring first to FIG. 1, a four-cycle horizontally opposed type engine E is shown. The engine is mountable on an automobile, a motorcycle, aircraft, and the like. A main body 11 of the engine E includes a left engine block 12L disposed on the left side as seen from the rear side of the engine E and a right engine block 12R disposed on the right side as seen from the rear side of the engine E.

The left engine block 12L includes a left cylinder block 13L, a left crankcase 14L formed integrally with the left cylinder block 13L, and a left cylinder head 15L connected to the side, opposite to the left crankcase 14L, of the left cylinder block 13L. Similarly, the right engine block 12R includes a right cylinder block 13R, a right crankcase 14R formed integrally with the right cylinder block 13R, and a right cylinder head 15R connected to the side, opposite to the right crankcase 14R, of the right cylinder block 13R.

The cylinder block 13L (or 13R) has a cylinder bore 16L (or 16R). A piston 18L (or 18R) is slidably fitted in the cylinder bore 16L (or 16R) in such a manner as to form a combustion chamber 17L (or 17R) between the cylinder bore 16L (or 16R) and the cylinder head 15L (or 15R).

Both of the engine blocks 12L and 12R are oppositely disposed with axial lines of the cylinder bores 16L and 16R arranged substantially in the horizontal direction. The left and right crankcases 14L and 14R are fastened to each other to form a crankcase 19 in cooperation with each other. A crankshaft 21 connected to the pistons 18L and 18R via connecting rods 20L and 20R is rotatably supported between the left and right crankcases 14L and 14R.

Referring to FIG. 2, the crankcase 19 is provided with a front journal wall 22F, an intermediate journal wall 22M, and a rear journal wall 22R, which are spaced from each other in the longitudinal direction. The journal walls 22F, 22M and 22R rotatably support three portions spaced from each other in the axial direction of the crankshaft 21. The crankshaft 21 is housed in a crank chamber 24 formed in the crankcase 19. A partition wall 25 defining the bottom of the crank chamber 24 is provided on the inner wall of the crankcase 19.

A rear end portion (left end portion in FIG. 2) of the crankshaft 21 projects rearwardly from the rear journal wall 22R. A rotor 27 of a generator 26 is coaxially connected to the rear end portion of the crankshaft 21. A stator 28 of the generator 26 is disposed behind the rear journal wall 22R and is fixedly supported by a supporting plate 29 fixed to the crankcase 19. A cover 30 for covering the generator 26 is fastened to a rear portion of the crankcase 19.

A drive gear 31 is fixed to the crankshaft 21 at a position between the rear journal wall 22R and the supporting plate 29. A rotating shaft 33, to which a first intermediate gear 32 meshing with the drive gear 31, is rotatably supported by the rear journal wall 22R and the supporting plate 29. A second intermediate gear 34, which is integrally provided on the rotating shaft 33, meshes with a gear 35 provided on a camshaft 36. The camshaft 36 having an axial line parallel to the crankshaft 21 is rotatably supported by the crankcase 19 at a position under the partition wall 25.

In this way, power is transmitted from the crankshaft 21 to the camshaft 36, at a reduction ratio of 1/2, via the drive gear 31, first intermediate gear 32, second intermediate gear 34, and gear 35.

A water pump 37 is mounted to the cover 30. A pump shaft 38 of the water pump 37 is coaxially connected to the rotating shaft 33 such that it does not rotate relative to the rotating shaft 33, whereby rotational power is transmitted from the crankshaft 21 to the water pump 37.

Referring to FIGS. 3 and 4, an oil pan 42 is connected to a lower portion of the crankcase 19 such that an oil reservoir chamber 43 is formed under the camshaft 36. An oil pump 44 is configured as a trochoide pump and is housed in the oil pan 42.

A pump housing 45 of the oil pump 44 is formed by connecting a pair of housing halves 46 and 47 to each other. A drive shaft 48 having an axial line parallel to the crankshaft 21 and the camshaft 36 is rotatably supported by the housing half 46. The drive shaft 48 is connected to a rotor 49 disposed between the housing halves 46 and 47.

A partition wall 46*a* is integrally provided on the housing half 46, whereby a power transmission chamber 50 partitioned from the oil reservoir chamber 43 formed in the oil pan 42 is formed between the partition wall 46*a* and a side wall of the oil pan 42. A gear 51 meshing with the gear 35 of the camshaft 36, which is rotated by power transmitted from the crankshaft 21, is fixed to an end portion, on the power transmission chamber 50 side, of the drive shaft 48. In this way, rotational power is transmitted from the crankshaft 21 to the oil pump 44.

The partition wall 46*a* has an approximately U-shaped transverse cross-section, which is opened upwardly. The upper end of the partition wall 46*a* is located at a position higher than the oil level L of oil in the oil reservoir chamber 43, so that oil does not flow from the oil reservoir chamber 43 side to the power transmission chamber 50 side. On the other hand, oil flows from the crank chamber 24 side into the power transmission chamber 50 via a gear train disposed in the power transmission route from the crankshaft 21 to the gear 51. The oil in the power transmission chamber 50 splashes to the oil reservoir chamber 43 side across the upper end of the partition wall 46*a* by rotation of the gear 51.

A pair of boss-like mounting portions 52 are integrally provided on a portion, corresponding to the housing half 46, of the bottom of the oil pan 42 in such a manner as to project therefrom. The housing half 46 is removably mounted on the mounting portions 52 with bolts 53. Similarly, a pair of boss-like mounting portions 52 are integrally provided on a portion, corresponding to the housing half 47, of the bottom of the oil pan 42 in such a manner as to project therefrom. The housing half 47 is removably mounted on the mounting portions 52 with bolts 53. Specifically, the pump housing 45 is removably mounted on the mounting portions 52 provided on the bottom of the oil pan 42.

An inlet 54 is provided in the housing half 46 of the pump housing 45. An oil strainer 55 connected to the inlet 54 is fixedly held between the housing half 46 and the oil pan 42. To be more specific, an upper portion of the oil strainer 55 is inserted from below in a lower portion of the housing half 46 such that it is continuous with the inlet 54. A lower peripheral edge of the oil strainer 55 is received on a receiving portion 56 provided on the bottom of the oil pan 42.

An outlet 57 is provided in the housing half 47 of the pump housing 45. A relief valve 58 connected to the outlet 57 is fixedly held between the housing half 47 and the oil pan 42, while being kept in a posture parallel to that of the oil strainer 55. To be more specific, an upper portion of the relief valve 58 is inserted from below in a lower portion of the housing half 47 such that it is continuous with the outlet 57. A lower end of the relief valve 58 is received by a raised portion 59 provided on the bottom of the oil pan 42.

An oil passage 61 in communication with the outlet 57 is provided in the housing half 47. An oil passage 62 in communication with the oil passage 61 is provided in the lower portion of the oil pan 42 when the pump housing 45 is mounted to the oil pan 42. An oil filter 63 connected to the oil passage 62 is removably mounted to an outer surface of a side wall of the oil pan 42. An oil passage 64 for oil cleaned by passing through the oil filter 63 is provided in the oil pan 42 and the crankcase 19. The oil passage 64 is in communication with a main gallery 65 provided in the crankcase 19.

A front portion of the crankshaft 21 is formed into a cylindrical hollow shape for reducing the weight of the crankshaft 21. A cylindrical spacer 66, having an annular chamber 67 formed between the inner surface of the crankshaft 21 and the outer surface of the spacer 66, is fitted in the cylindrical hollow portion of the crankshaft 21. The annular chamber 67 extends at least between portions corresponding to the front and intermediate journal walls 22F and 22M of the crankcase 19. Both axial ends of the annular chamber 67 are sealed in a fluid tight manner by mounting seal members to both ends of the spacer 66 or press-fitting both the ends of the spacer 66 in the crankshaft 21.

An oil passage 68 for supplying oil to a portion to be lubricated between the intermediate journal wall 22M and the crankshaft 21 is provided in the crankcase 19 in communication with the main gallery 65. The crankshaft 21 has a passage hole 69 for supplying oil from the portion to be lubricated between the intermediate journal wall 22M and the crankshaft 21 to the annular chamber 67. The crankshaft 21 also has a passage hole 70 for supplying oil from the annular chamber 67 to a portion to be lubricated between the front journal wall 22F and the crankshaft 21.

The crankshaft 21 integrally includes a crank pin 21L connected to the connecting rod 20L on the left engine block 12L side and a crank pin 21R connected to the connecting rod 20R on the right engine block 12R side. An oil passage 71 for supplying oil from the annular chamber 67 to a portion to be lubricated between the connecting rod 20L and the crank pin 21L is provided in the crankshaft 21. Oil is supplied from the main gallery 65 to a portion to be lubricated between the rear journal wall 22R and the crankshaft 21. An oil passage 72 for supplying oil from the portion to be lubricated between the rear journal wall 22R and the crankshaft 21 to a portion to be lubricated between the connecting rod 20R and the crank pin 21R is provided in the crankshaft 21.

In addition, in order to supply oil to the portion to be lubricated between the connecting rod 20L and the crank pin 21L, the entire cylindrical hollow portion of the crankshaft 21 can be used as an oil passage. However, in this case, since the volume of the oil passage may become excessively large, the hydraulic pressure rising time upon start-up of the engine E may be retarded and a residual amount of oil upon oil exchange may be increased. According to this embodiment, the annular chamber 67 formed between the cylindrical hollow portion of the crankshaft 21 and the spacer 66 is, as described above, used as the oil passage. Accordingly, the passage volume can be set to a suitable value, to prevent the retardation of the hydraulic pressure rising time and to prevent the increase in residual amount of oil upon oil exchange. Also, since the inside diameter of the cylindrical hollow portion of the crankshaft 21 can be set to a relatively large value without increasing the passage volume, it is not required to increase the accuracy of the penetrating depths of the passage holes 69 and 70. Furthermore, by making the spacer 66 from a material lighter in weight than that of the crankshaft 21, the entire crankshaft 21 can be made lighter in weight.

The oil, which has lubricated the portion to be lubricated between the connecting rod 20L and the crank pin 21L and the portion to be lubricated between the connecting rod 20R and the crank pin 21R, is released into the crank chamber 24 and is accumulated on the partition wall 25. Oil through-holes 73 for directing the oil accumulated on the partition wall 25 to portions of the crankcase 19 for supporting both ends of the camshaft 36 are provided in the partition wall 25. As a result, the oil is supplied to portions to be lubricated between the camshaft 36 and the crankcase 19.

Referring to FIGS. 5 and 6, a pair of intake valve ports 76 and a pair of exhaust valve ports 77 are provided in the cylinder head 15R of the right engine block 12R in such a manner as to be positioned on both sides of a first virtual plane 78 containing the axial line of the cylinder bore 16R and passing through the center of the combustion chamber 17R. The pair of intake valve ports 76 and the pair of exhaust valve ports 77 face toward the combustion chamber 17R. The first virtual plane 78 crosses an axial line C of the crankshaft 21 at an angle $\alpha$ on the projection plane perpendicular to the axial line of the cylinder bore 16R (parallel to the paper in FIG. 5).

Referring to FIGS. 7 and 8, a pair of ignition plugs 80 is mounted in the cylinder head 15R in such a manner that the end portions thereof project into the combustion chamber 17R. The axial lines of the ignition plugs 80 pass through the center of the combustion chamber 17R and are disposed on the first virtual plane 78.

The ignition plugs 80 are disposed symmetrically with respect to the second virtual plane 79 perpendicular to the first virtual plane 78, and are mounted in the cylinder head 15R such that they are tilted with a distance therebetween becoming smaller towards the combustion chamber 17R. The end portions, projecting in the combustion chamber 17R, of both the ignition plugs 80 are disposed in a region surrounded by both of the intake valve ports 76 and both of the exhaust valve ports 77.

Both of the ignition plugs 80 are connected to an ignition circuit (not shown) and are usually operated in synchronization with each other by the ignition circuit.

Inner ends of plug insertion cylinders 81, in which the ignition plugs 80 are to be inserted, are fixedly fitted in the cylinder head 15R. Outer ends of the plug insertion cylinders 81 are located in opening portions 83 formed in the head cover 82R fastened to the cylinder head 15R. Spaces between the outer ends of the plug insertion cylinders 81 and the head cover 82R are sealed.

A single intake port 84, in communication with both of the intake valve ports 76 and having its axial line disposed on the second virtual plane 79, is provided in the cylinder head 15R such that it is opened in an upper side surface of the cylinder head 15R. A single exhaust port 85, in communication with both of the exhaust valve ports 77 and having its axial line disposed on the second virtual plane 79, is provided in the cylinder head 15R such that it is opened in a lower side surface of the cylinder head 15R.

An intake pipe 74R is connected to the upper side surface of the cylinder head 15R such that it is in communication with the intake port 84. A fuel injection valve 75R is provided in the intake pipe 74R.

Each of the intake valve ports 76 is openable/closable by an intake valve VI as an engine valve. A valve stem 86 of the intake valve VI is slidably fitted in a guide cylinder 87 provided in the cylinder head 15R. The intake valve VI is elastically biased in the valve closing direction by a valve spring 89 provided between the cylinder head 15R and a retainer 88 fixed to an end, projecting from the guide cylinder 87, of the valve stem 86.

Each of the exhaust valve ports 77 is openable/closable by an exhaust valve VE as an engine valve. A valve stem 90 of the exhaust valve VE is slidably fitted in a guide cylinder 91 provided in the cylinder head 15R. The exhaust valve VE is elastically biased in the valve closing direction by a valve spring 93 provided between the cylinder head 15R and a retainer 92 fixed to an end, projecting from the guide cylinder 91, of the valve stem 90.

Like the right cylinder head 15R, the left cylinder head 15L on the left engine block 12L side is provided with a pair of intake valves VI and a pair of exhaust valves VE, and is also provided with a pair of ignition plugs 80. A head cover 82L is fastened to the cylinder head 15L. An intake pipe 74L provided with a fuel injection valve 75L is connected to an upper side surface of the cylinder head 15L.

The pair of the intake valves VI and the pair of the exhaust valves VE disposed in the right cylinder head 15R are opened/closed by a valve system 94R. The pair of the intake valves VI and the pair of the exhaust valves VE disposed in the left cylinder head 15L are opened/closed by a valve system 94L. The configuration of the valve system 94R is the same as that of the valve system 94L. Accordingly, only the configuration of the valve system 94R on the right cylinder head 15R side will be hereinafter described.

The valve system 94R includes a holder 97 which integrally includes cylindrical lifter housings 95 coaxial with valve stems 86 of both of the intake valves VI and cylindrical lifter housings 96 coaxial with valve stems 90 of both of the exhaust valves VE. The holder 97 is fastened to the cylinder head 15R. An intake side rocker shaft 98 and an exhaust side rocker shaft 99 have axial lines parallel to each other and are fixedly supported by the holder 97. An intake side rocker arm 100 is rockably supported by the intake side rocker shaft 98 and an exhaust side rocker arm 101 is rockably supported by the exhaust side rocker shaft 99. Lifters 102 are slidably fitted in the lifter housings 96 such that they are interposed between the intake rocker arm 100 and both of the intake valves VI. Lifters 103 are slidably fitted in the lifter housings 97 such that they are interposed between the exhaust side rocker arm 101 and both of the exhaust valves VE. The camshaft 36 is interlocked with the crankshaft 21 at a reduction ratio of 1/2. A push rod 104 imparts a valve opening force to the intake side rocker arm 100 according to the rotation of the camshaft 36. A pull rod 105 imparts a valve opening force to the exhaust side rocker arm 101 according to the rotation of the camshaft 36.

The intake side and exhaust side rocker shafts 98 and 99 are mounted to the cylinder head 15 such that they are disposed on both sides of the pair of ignition plugs 80. To be more specific, the intake side rocker shaft 98 is disposed between the pair of the intake valves VI, i.e., the lifter housings 95 and both of the ignition plugs 80. The exhaust side rocker shaft 99 is disposed between the pair of exhaust valves VE, i.e., the lifter housings 96 and both of the ignition plugs 80. On the projection plane perpendicular to the axial line of the cylinder bore 16R (parallel to the paper in FIG. 7), the postures of both of the rocker shafts 98 and 99 are set such that axial lines thereof extend in parallel to the first virtual planes 78 on both sides of the first virtual plane 78 while crossing the axial line C of the crankshaft 21.

The lifter 102 (or 103) is formed into a cylindrical shape with its bottom closed. The lifter 102 (or 103) has a diameter larger than an outside diameter of the valve stem 86 of the intake valve VI (or the valve stem 90 of the exhaust valve VE). The lifter 102 (or 103) is slidably fitted in the lifter housing 95 (or 96) with the closed end thereof directed toward the rocker arm 100 (or 101) side. The closed end of the lifter 102 (or 103) has a plurality of through-holes 106 (or 107) arranged along a circular line for reducing the weight of the lifter 102 (or 103).

A pair of drive arms 100*a* and 100*b* extending to the lifters 102 is integrally provided on the intake side rocker arm 100. The leading ends of the drive arms 100*a* and 100*b* are in contact with the outer surfaces of the closed ends of the lifters 102 in order to impart driving forces for pressing the intake valves VI in the valve opening direction to the valve stems 86 of the intake valves VI via the lifters 102.

A pair of drive arms 101*a* and 101*b* extending to the lifters 103 are integrally provided on the exhaust side rocker arm 101. The leading ends of the drive arms 101*a* and 101*b* are in contact with the outer surfaces of the closed ends of the lifters 103 in order to impart driving forces for pressing the exhaust valves VE in the valve opening direction to the valve stems 90 of the exhaust valves VE via the lifters 103.

It should be noted that according to this embodiment, to adjust a tappet clearance, as shown in FIG. 6, a shim 121 is held between the valve stem 86 and the lifter 102 and a shim 122 is held between the valve stem 90 and the lifter 103. In place of the shim 121 (or 122), a tappet screw screwed in the leading end of the drive arm 100*a* (or 100*b*, 101*a*, or 101*b*) such that it is adjustable in the forward or backward direction may be brought into contact with the lifter 102 (or 103).

An oil passage 108, to which oil is supplied from the oil pump 44, is provided in both the cylinder head 15R and the holder 97 connected to the cylinder head 15R. An oil hole 109, which is in communication with the oil passage 108 and annular recesses 110 and 111 provided in inner surfaces of the lifter housings 95 and 96, is provided in the holder 97 and in the lifter housings 95 and 96.

Referring to FIG. 9, the camshaft 36 disposed under the crankshaft 21 is provided with an intake side cam 112R corresponding to the intake valves VI on the right engine block 12R side, an intake side cam 112L corresponding to the intake valves VI on the left engine block 12L side, an exhaust side cam 113R corresponding to the exhaust valves VE on the right engine block 12R side, and an exhaust side cam 113L corresponding to the exhaust valves VE on the left engine block 12L side.

Cam followers 114R and 114L following the intake side cams 112R and 112L and cam followers 115R and 115L following the exhaust side cams 113R and 113L are rockably supported by the crankcase 19. The cam followers 114R and 115L are disposed on the right engine block 12R side with respect to the camshaft 36, and are rockably supported by a common supporting shaft 118 mounted to the crankcase 19. The cam followers 114L and 115R are disposed on the left engine block 12L side with respect to the camshaft 36, and are rockably supported by a common supporting shaft 119 mounted to the crankcase 19.

Referring to FIG. 7, input arms 100*c* and 101*c* extending, on the projection plane perpendicular to the axial line of the cylinder bore 16R, from the intake side rocker arm 100 and the exhaust side rocker arm 101 to the camshaft 36 side (lower side of FIG. 7), are provided on the rocker arms 100 and 101, respectively. The input arm 100*c* of the intake side rocker arm 100 is connected to the cam follower 114R by means of a push rod 104. The input arm 101*c* of the exhaust side rocker arm 101 is connected to the cam follower 115R by means of the pull rod 105. The push rod 104 acts, upon movement thereof in the direction opposite to the camshaft 36, to push up the input arm 100*c* for rocking the intake side rocker arm 100 in the valve opening direction. The pull rod 105 acts, upon movement thereof on the camshaft 36 side, to pull the input arm 101*c* for rocking the exhaust side rocker arm 101 in the valve opening direction.

A rod chamber 120 extending from the crankcase 19 to both of the cylinder heads 15R and 15L is formed under the engine main body 11. The push rod 104 and the pull rod 105 are contained and disposed in the rod chamber 120. In addition, since the tensile strength of a material for forming both of the rods 104 and 105 is higher than the compression strength thereof, the diameter of the pull rod 105 is set to be smaller than that of the push rod 104.

Spherical portions 104*a* and 104*b* are provided on both ends of the push rod 104. The spherical portion 104*a* at one end of the push rod 104 is swingably received on the cam follower 114R. The spherical portion 104*b* at the other end of the push rod 104 is swingably received on the leading end of the input arm 100*c* provided on the intake side rocker arm 100.

As shown in FIG. 10, an approximately U-shaped fork 116 opened toward the side opposite to the camshaft 36 is integrally provided on the cam follower 115R. A pin 123 fixed in one end of the pull rod 105 by press-fitting or the like is engaged with the fork 116. Furthermore, an approximately U-shaped fork 117 opened on the side opposite to the camshaft 36 is integrally provided on the leading end of the input arm 101*c* provided on the exhaust side rocker arm 101. A pin 124 fixed in the other end of the pull rod 105 is engaged with the fork 117. With this configuration, both of the ends of the pull rod 105 can be connected to the input arm 101*c* provided on the exhaust side rocker arm 101 and the cam follower 115R only by engaging both of the ends of the pull rod 105 with the forks 116 and 117. Accordingly, one end of the pull rod 105 can be connected to the cam follower 115R from the cylinder head 15R side without disassembly of the oil pan 42. This results in the maintenance being improved.

It should be noted that when an engine E as described above is installed in an air plane 150 as shown in FIG. 11, the engine E is accommodated in a cowl 152 attached to a front portion of a body 151 such that an axial line of the crankshaft 21 extends in the forward and backward direction. Furthermore, the engine E is resiliently supported on a support frame 153 disposed in the cowl 152.

A spinner 155 having a plurality of propellers 154 is disposed forwardly of the cowl 152, and the crankshaft 21 of the engine E is coupled coaxially to the spinner 155.

Referring also to FIG. 12, an intake manifold 156 is disposed above the engine E and extends in the forward and backward direction. A pair of intake pipes 74L and 74R are connected to the opposite sides of a front portion of the intake manifold 156 such that they communicate with the intake ports 84 of the cylinder heads 15L and 15R of the cylinder blocks 12L and 12R of the engine E.

An air cleaner 157 is disposed below a rear portion of the intake manifold 156 on the rear side of the engine E and is connected to a rear portion of the intake manifold 156. In addition, a suction pipe 158 is connected to a lower portion of the air cleaner 157 and extends forwardly below the engine E. The forward end of the suction pipe 158 is open to a screen 159 provided at a lower portion of the front end of the cowl 152.

A pair of radiators 160, 160 is disposed on the opposite left and right sides of a lower portion of the engine E. The radiators 160, 160 are accommodated in a pair of first air ducts 161, 161, which extends forwardly upwards. The lower ends of the first air ducts 161, 161 are open obliquely rearwards in the cowl 152. A second air duct 162 is connected in common to the upper ends of the two first air ducts 161, 161. The second air duct 162 includes a common duct portion 162*a* extending leftwardly and rightwardly below a front portion of the engine E and having, at a front and central portion thereof, and air intake opening 163 opposed to the screen 159. A pair of branch duct portions 162*b*, 162*b* extend rearwardly upwards from the opposite left and right end portions of the common duct portion 162*a* and connect to the upper ends of the first air ducts 161, 161.

In particular, the radiators 160, 160 disposed on the opposite left and right sides of a lower portion of the engine E are cooled by air fed from the screen 159 at the front end of the cowl 152 to the air intake opening 163 by the propellers 154 and flowing through the left and right first air ducts 161, 161 separately from the second air duct 162.

The support frame 153 is formed from; for example, a plurality of pipe members combined in such a manner as to embrace the engine E from the rear. In addition; for example, mounting arms 164, 164 are inclined such that the distances between them increase rearwardly at four locations of a rear portion of the crankcase 19 of the engine E. The mounting arms 164, 164 are provided such that they may be positioned at the corners of an imaginary rectangular parallelepiped centered at the axial line of the crankshaft 21 in a plane perpendicular to the axial line. The mounting arms 164, 164, are mounted on the support frame 153 through resilient mounts 165, 165.

Referring to FIG. 13, each resilient mount 165 includes a cylindrical collar 166, a cylindrical support tube 167 fixed to the support frame 153 and coaxially surrounding the collar 166, and a mount rubber member 168 interposed between the collar 166 and the support tube 167 with inner and outer peripheries thereof baked to an outer periphery of the collar 166 and an inner periphery of the support tube 167. Opposite ends of the collar 166 project from the opposite ends of the support tube 167.

The collar 166 has one end contacting with a mounting arm 164. The collar 166 contacts, at the other end thereof, with a holding down plate 169. A bolt 170 has an increased diameter head portion 170*a* for engaging with an outer face of the holding down plate 169 and extending through the holding down plate 169 and the collar 166. The bolt 170 is screwed in the mounting arm 164 such that the mounting arm 164, i.e., the engine E, is resiliently mounted on the support frame 153 by tightening the bolt 170.

The function of this embodiment will be described below. Since the pump housing 45 of the oil pump 44 for supplying lubricating oil to various portions of the engine E is removably mounted on the mounting portions 52 provided on the bottom of the oil pan 42 connected to the lower portion of the crankcase 19, it is possible to set the oil pump 44 at a relatively low position in the engine E. Accordingly, the center of gravity of the engine E can be lowered and the suction efficiency and maintenance performance of the oil pump 44 can be improved.

Since the oil strainer 55 connected to the inlet 54 of the oil pump 44 is fixedly held between the oil pan 42 and the pump housing 45, it is possible to fix the oil strainer 55 between the oil pan 42 and the pump housing 45 without use of parts specialized for fixture thereof such as bolts. Accordingly, the number of parts and the number of assembling steps can be reduced. Furthermore, since an oil suction passage between the inlet 54 of the oil pump 44 and the oil strainer 55 can be shortened, the pumping loss of the oil pump 44 can be reduced.

Since the relief valve 58 connected to the outlet 57 of the oil pump 44 is fixedly held between the oil pan 42 and the pump housing 45 while being kept in a posture parallel to that of the oil strainer 55, the relief valve 58 can be disposed by making effective use of a space which is formed on a side of the oil strainer 55 by holding the oil strainer 55 between the pump housing 45 and the oil pan 42. In addition, the relief valve is directly connected to the pump housing 45 of the oil pump 44. Accordingly, it is possible to shorten and simplify the oil discharge passage, composed of the oil passages 61 and 62 extending from the oil filter 63 mounted on the outer surface of the side wall of the oil pan 42, to the oil pump 44. Furthermore, since a relief port of the relief valve 58 can be easily set in the oil in the oil pan 42, it is possible to prevent the oil from bubbling.

In addition, the partition wall 46*a* forming the power transmission chamber 50, which is partitioned from the oil reservoir chamber 43 formed in the oil pan 42, between the side wall of the oil pan 42 and the partition wall 46*a*, is formed on the housing half 46 constituting part of the pump housing 45. The gear 51 rotated by power transmitted from the crankshaft 21 is fixed to the end portion, on the power transmission chamber 50 side, of the drive shaft 48 rotatably supported by the pump housing 45. Accordingly, since the gear 51 rotated for transmitting a power from the crankshaft 21 to the drive shaft 48 does not agitate the oil reserved in the oil reservoir chamber 43 in the oil pan 42, it is possible to prevent the occurrence of friction loss and oil mist due to agitation of the oil.

The lifter 102 (or 103) is formed into a cylindrical shape with its bottom closed. The lifter 102 (or 103) has a diameter larger than that of the valve stem 86 (or 90) and is interposed between the valve stem 86 of the intake valve VI (or the valve stem 90 of the exhaust valve VE) and the intake side rocker arm 100 (or exhaust side rocker arm 101) which is interlocked to rock with the rotation of the camshaft 36. The lifter 102 (or 103) is slidably fitted in the cylindrical lifter housing 95 (or 96), which is integrally provided on the holder 97 fixed to the cylinder heads 15R and 15L, and which is coaxial with the valve stem 86 (or 90).

With this configuration, a drive force from the intake side rocker arm 100 (or the exhaust side rocker arm 101) is applied to the valve stem 86 of the intake valve VI (or the valve stem 90 of the exhaust valve VE) via the lifter 102 (or 103), so that a bending load is not applied to the valve stem 86 (or 90), which has a relatively small diameter. As a result, it is possible to prevent the occurrence of partial wear, galling, and the like in the guide cylinder 87 (or 91). Furthermore, the lifter 102 (or 103) has a relatively large diameter. Accordingly, even if a bending load is applied from the intake side rocker arm 100 (or exhaust side rocker arm 101), it is possible to minimize the occurrence of partial wear, galling, and the like between the lifter housing 95 (or 96) and the lifter 102 (or 103). Therefore, the reliability of the valve systems 94R and 94L can be improved.

The oil hole 109 is opened in the inner surfaces of the lifter housings 95 and 96 and is provided in the holder 97 and in the lifter housings 95 and 96. Accordingly, it is possible to make the sliding motion of the lifter 102 (or 103) in the lifter housing 95 (or 96) smoother. Therefore, the occurrence of partial wear, galling, and the like between the lifter housing 95 (or 96) and the lifter 102 (or 103) can be more surely prevented.

In this case, if a point of the lifter 102 (or 103), to which a drive force is applied from the intake side rocker arm 100 (or 101), is offset from the center of the lifter 102 (or 103), the lifter 102 (or 103) can be rotated around its axial line. Correspondingly, the intake valve VI (or exhaust valve VE) can be rotated, to thereby prevent seizing on one side of the intake valve VI (or exhaust valve VE). From this viewpoint, according to this embodiment, the intake valve VI (or exhaust valve VE) can be easily rotated by smoothly sliding the lifter 102 (or 103) in the lifter housing 95 (or 96).

The pair of intake valve ports 76 and the pair of exhaust valve ports 77 are provided in the cylinder head 15R (or 15L) such that they are located on both sides of the first virtual plane 78 containing the axial line of the cylinder bore 16R (or 16L) and passing through an approximately center of the combustion chamber 17R (17L). The pair of intake valve ports 76 and the pair of exhaust valve ports 77 face toward the combustion chamber 17R (17L). The pair of ignition plugs 80 is mounted in the cylinder head 15R (or 15L). Both of the ignition plugs 80 are approximately symmetrical with respect to the second virtual plane 79 passing through the center of the combustion chamber 17R (or 17L) and are perpendicular to the first virtual plane 78. Furthermore, the ignition plugs 80 are disposed in the cylinder head 15R (or 15L) in such a manner that the axial lines thereof extend substantially along the first virtual plane 78 and are tilted with a distance therebetween becoming smaller toward the combustion chamber 17R (or 17L). The ends of the ignition plugs 80, projecting in the combustion chamber 17R (or 17L), are disposed in the region surrounded by both of the intake valve ports 76 and both of the exhaust valve ports 77.

With this configuration, the ends of the pair of ignition plugs 80, projecting in the combustion chamber 17R (or 17L), are disposed in proximity to an approximately central portion in the combustion chamber 17R (or 17L). Accordingly, it is possible to ideally propagate flame in the combustion chamber 17R (or 17L). Furthermore, even if an accidental firing of either of the ignition plugs 80 occurs, since the other ignition plug 80 is located at the approximately central portion of the combustion chamber 17R (or 17L), it is possible to minimize the deterioration of the flame propagation condition.

Both of the ignition plugs 80 are disposed in an approximately V-shape opened in the direction opposite to the combustion chamber 17R (or 17L), as seen from the direction perpendicular to the first virtual plane 78. Furthermore, both of the ignition plugs 80 can be easily mounted in the cylinder head 15R (or 15L) with the ends of the ignition plugs 80, projecting in the combustion chamber 17R (or 17L). Accordingly, the ignition plugs 80 are allowed to be disposed in proximity to an approximately central portion of the combustion chamber 17R (or 17L).

Both of the ignition plugs 80 are collectively disposed in the vicinity of the central portion of the combustion chamber 17R (or 17L). Accordingly, it is possible to enhance the degree of freedom of the shape of a water jacket on the cylinder head 15R (or 15L) side and the degree of freedom of disposition of fastening bolts for fastening the cylinder head 15R (or 15L) to the cylinder block 13R (or 13L). Accordingly, the sealing performance between the cylinder head 15R (or 15L) and the cylinder block 13R (or 13L) as well as the cooling performance can be improved.

The intake side and exhaust side rocker arms 100 and 101 are rockably supported by the intake side and exhaust side rocker shafts 98 and 99 having the axial lines extending along the first virtual plane 78. The virtual plane 78 contains the axial line of the cylinder bore 16R and passes through the center of the combustion chamber 17R and crosses the axial line of the crankshaft 21 at the angle on the projection plane perpendicular to the axial line of the cylinder bore 16R. The intake side and exhaust side rocker shafts 98 and 99 are mounted to the cylinder head 15R (or 15L) such that they are disposed on both of the sides of the ignition plugs 80. With this configuration, it is possible to set the width of the cylinder head 15R (or 15L) at a relatively small value in the direction along the second virtual plane 79. Accordingly, the engine E can be made more compact.

The input arm 101*c* extends on the projection plane perpendicular to the axial line of the cylinder bore 16R (or 16L) from the rocker arm 101 to the camshaft 36 side. The input arm 101*c* is provided on the exhaust side rocker arm 101. The pull rod 105 reciprocates in the axial direction according to the rotation of the camshaft 36. The pull rod 105 is connected to the input arm 101*c* in order to rock the exhaust side rocker arm 101 in the valve opening direction when the pull rod 105 is moved to the camshaft 36 side. With this configuration, it is not required to enlarge the width of the cylinder head 15R (15L) in the direction along the axial line of the crankshaft 21 for disposing the pull rod 105. Accordingly, the size and weight of the engine E in the direction along the axial line of the crankshaft 21 can be reduced.

The input arm 100*c* extends on the projection plane perpendicular to the axial line of the cylinder bore 16R (or 16L), from the rocker arm 101 to the camshaft 36 side. The input arm 100*c* is provided on the intake side rocker arm 100. The push rod 104 reciprocates in the axial direction according to the rotation of the camshaft 36. The push rod 104 is connected to the input arm 100*c* in order to rock the intake side rocker arm 100 in the valve opening direction when the push rod 104 is moved to the camshaft 36 side.

The intake and exhaust side rocker shafts 98 and 99 and the intake side and exhaust side rocker arms 100 and 101 are disposed as described above. Furthermore, an opening/closing force is imparted to the intake side rocker arm 100 by the pull rod 105 and to the exhaust side rocker arm 101 by the push rod 104. Accordingly, the space in the cylinder head 15R (or 15L) necessary for disposing the rocker shafts 98 and 99 and the rocker arms 100 and 101 constituting parts of the valve system 94R (or 94L) can be can be decreased in size in the direction along the axial line of the crankshaft 21.

Furthermore, it is not required to enlarge the width of the cylinder head 15R (or 15L) in the direction along the axial line of the crankshaft 21 for disposing the pull rod 105 and the push rod 104. Accordingly, a drive system between the camshaft 36 and both the rocker arms 100 and 101 can be disposed in good balance. This makes it possible to reduce the size and weight of the engine E in the direction along the axial line of the crankshaft 21.

As mentioned above, the pair of the intake valves VI and the pair of the exhaust valves VE are disposed in the cylinder head 15R (or 15L) in such a manner as to face the combustion chamber 17R (or 17L). Accordingly, it is possible to improve the suction efficiency and thereby increase the output torque in a low speed rotational range of the engine E.

Figure 14:
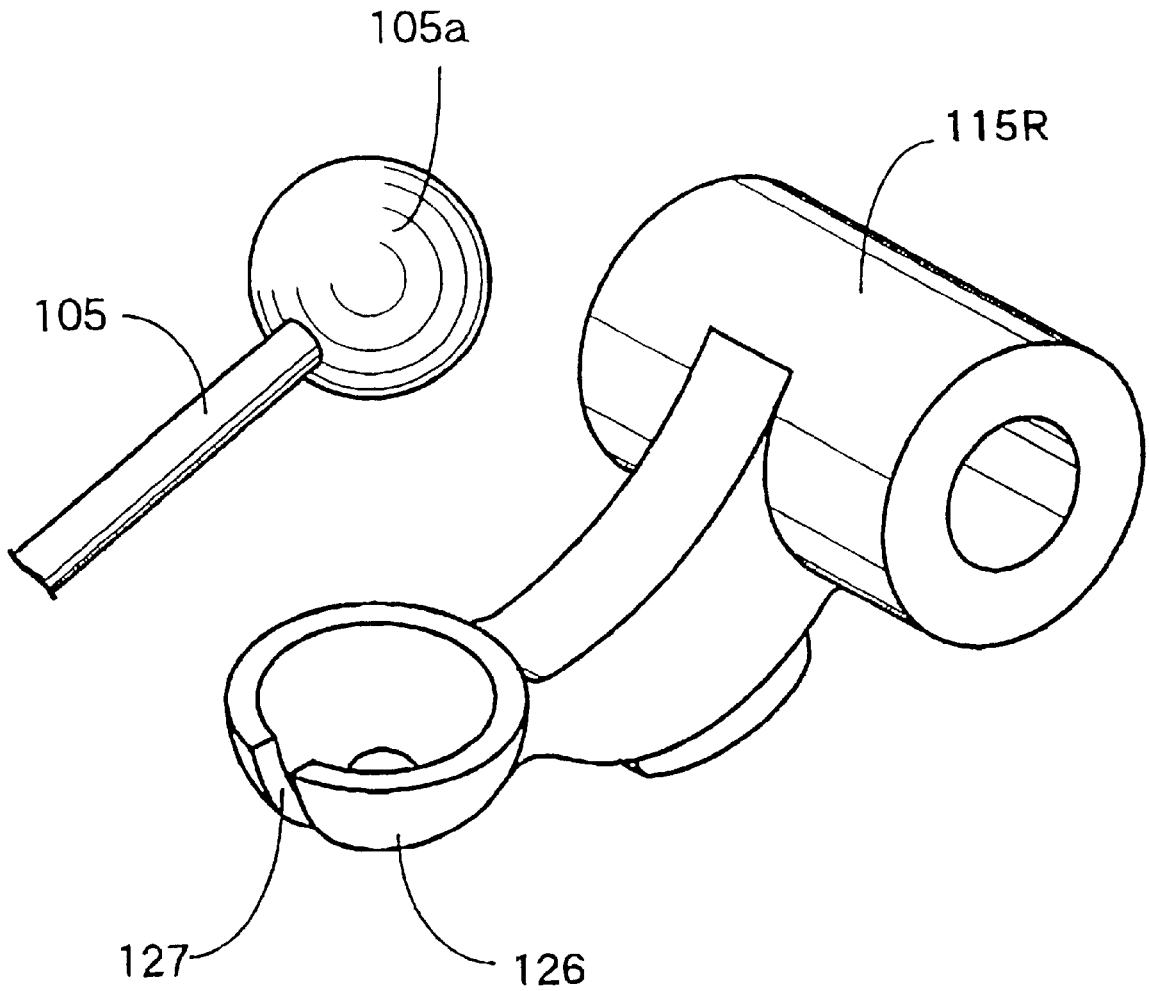
FIG. 14 is an exploded perspective view, corresponding to FIG. 10, showing another embodiment of the present invention.

FIG. 14 shows another embodiment of the present invention. A spherical portion 105*a* is provided at one end of a pull rod 105. An engagement portion 126 is formed into a bowl shape and has a slit 127 allowing the insertion of the pull rod 105. The engagement portion 126 is provided on a cam follower 115R for being connected to the one end of the pull rod 105. The one end of the pull rod 105 is connected to the cam follower 115R by engaging the spherical portion 105*a* with the engagement portion 126.

In this embodiment, since the one end of the pull rod 105 can be connected to the cam follower 115R from the cylinder head 15R side without disassembly of the oil pan 42, it is possible to improve the maintenance of the device.

While the preferred embodiments have been described above, the present invention is not limited thereto, and it is to be understood that various changes in design may be made without departing from the scope of the claims.

For example, the present invention can be widely applied to engines other than the horizontally opposed type two-cylinder engine described above.

As described above, according to the first aspect of the present invention, a space required for disposing the rocker shaft, the rocker arm, and the like constituting part of the valve system can be made smaller in the direction along the axial line of the crankshaft. Furthermore, since it is not required to enlarge the width of the cylinder head in the direction along the axial line of the crankshaft for disposing the pull rod, it is possible to reduce the size and weight of the engine in the direction along the axial line of the crankshaft.

According to the second aspect of the present invention, it is possible to improve the suction efficiency and increase the output torque in a low speed rotational range. Also, a space required in the cylinder head for disposing the first and second rocker shafts, the first and second rocker arms, and the like constituting part of the valve system can be made smaller in the direction along the axial line of the crankshaft. Furthermore, since it is not required to enlarge the width of the cylinder head in the direction along the axial line of the crankshaft for disposing the pull rod and the push rod, a drive system between the camshaft and both the rocker arms can be disposed in good balance. This results in the possibility of reducing the size and weight of the engine in the direction along the axial line of the crankshaft.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine, comprising:

a cylinder block having a crankcase formed integrally therewith and a cylinder bore formed therein;

a cylinder head connected to said cylinder block;

a crankshaft rotatably supported by said crankcase;

a piston, said piston being slidably fitted in said cylinder bore and being operatively connected to said crankshaft;

a camshaft having an axial line parallel to an axial line of said crankshaft, said camshaft being interlocked with said crankshaft at a reduction ratio of 1/2, said camshaft being disposed on one side of said crankshaft and being rotatably supported by said crankcase;

a rocker shaft fixedly supported by said cylinder head;

a rocker arm supported by said rocker shaft for rocking motion thereon in accordance with rotation of said camshaft, said rocker arm being operatively connected to engine valves;

said rocker shaft is arranged to have an axial line thereof crossing an axial line of said crankshaft on a projection plane perpendicular to an axial line of said cylinder bore; and an input arm extending on said projection plane from said rocker arm to said one side of said crankshaft is provided on said rocker arm rockably supported by said rocker shaft; and a rod reciprocating in an axial direction in accordance with the rotation of said camshaft is connected to said input arm to rock said rocker arm in a valve opening direction.

2. The engine according to claim 1, wherein said rod is a pull rod, said rocker arm being rocked in the valve opening direction when said pull rod is moved in a direction toward said camshaft.

3. The engine according to claim 1, wherein said rod is a push rod, said rocker arm being rocked in the valve opening direction when said push rod is moved in a direction away from said camshaft.

4. The engine according to claim 1, further comprising a holder, said holder supporting said rocker shaft and being connected to said cylinder head.

5. A valve system for an engine, the engine including a cylinder block having a crankcase formed integrally therewith and a cylinder bore formed therein, a cylinder head connected to the cylinder block, a crankshaft rotatably supported by the crankcase, a piston slidably fitted in the cylinder bore and being operatively connected to the crankshaft, and a camshaft having an axial line parallel to an axial line of the crankshaft, the camshaft being interlocked with the crankshaft at a reduction ratio of 1/2 and being disposed on one side of the crankshaft rotatably supported by the crankcase, said valve system comprising:

a rocker shaft fixedly supportable by the cylinder head;

a rocker arm supported by said rocker shaft for rocking motion thereon in accordance with rotation of the camshaft, said rocker arm being operatively connected to engine valves of the engine;

said rocker shaft is arranged to have an axial line thereof crossing an axial line of the crankshaft on a projection plane perpendicular to an axial line of the cylinder bore; and an input arm extending on said projection plane from said rocker arm to said one side of said crankshaft is provided on said rocker arm rockably supported by said rocker shaft.

6. The valve system according to claim 5, further comprising a rod reciprocating in an axial direction in accordance with the rotation of said camshaft, said rod being connected to said input arm to rock said rocker arm in a valve opening direction.

7. The valve system according to claim 6, wherein said rod is a pull rod, said rocker arm being rocked in the valve opening direction when said pull rod is moved in a direction toward said camshaft.

8. The valve system according to claim 6, wherein said rod is a push rod, said rocker arm being rocked in the valve opening direction when said push rod is moved in a direction away from said camshaft.

9. The valve system according to claim 5, further comprising a holder, said holder supporting said rocker shaft and being connectable to said cylinder head.

10. An engine, comprising:

a cylinder block having a crankcase formed integrally therewith and a cylinder bore formed therein;

a cylinder head connected to said cylinder block;

a crankshaft rotatably supported by said crankcase;

a piston, said piston being slidably fitted in said cylinder bore and being operatively connected to said crankshaft;

a camshaft having an axial line parallel to an axial line of said crankshaft, said camshaft being interlocked with said crankshaft at a reduction ratio of 1/2, said camshaft being disposed on one side of said crankshaft and being rotatably supported by said crankcase;

a first rocker shaft fixedly supported by said cylinder head;

a second rocker shaft fixedly supported by said cylinder head a first rocker arm supported by said first rocker shaft for rocking motion thereon in accordance with rotation of said camshaft, said rocker arm being operatively connected to a pair of first engine valves;

a second rocker arm supported by said second rocker shaft for rocking motion thereon in accordance with rotation of said camshaft, said rocker arm being operatively connected to a pair of second engine valves, said second engine valves being different than said first engine valves;

said first rocker shaft and said second rocker shaft are arranged to have axial lines thereof crossing an axial line of said crankshaft on a projection plane perpendicular to an axial line of said cylinder bore;

a first input arm and a second input arm extending on said projection plane from said first rocker arm and said second rocker arm, respectively, to said one side of said crankshaft are provided on said first rocker arm and said second rocker arm, respectively;

a first rod and a second rod reciprocating in axial directions in accordance with the rotation of said camshaft, said first rod and said second rod being connected to said first input arm and said second input arm, respectively, to rock said first rocker arm and said second rocker arm in valve opening directions, respectively.

11. The engine according to claim 10, wherein said first rod is a push rod, said first rocker arm being rocked in the valve opening direction when said push rod is moved in a direction away from said camshaft.

12. The engine according to claim 10, wherein said second rod is a pull rod, said second rocker arm being rocked in a valve opening direction when said pull rod is moved in a direction toward said camshaft.

13. The engine according to claim 11, wherein said second rod is a pull rod, said second rocker arm being rocked in a valve opening direction when said pull rod is moved in a direction toward said camshaft.

14. The engine according to claim 10, wherein said first rocker shaft and said second rocker shaft are disposed parallel to each other.

15. The engine according to claim 10, further comprising a holder, said holder supporting said first rocker shaft and said second rocker shaft and being connected to said cylinder head.

* * * * *